US009017187B2

(12) United States Patent
Abe

(10) Patent No.: US 9,017,187 B2
(45) Date of Patent: Apr. 28, 2015

(54) GOLF CLUB HEAD

(71) Applicant: Dunlop Sports Co. Ltd., Kobe-shi, Hyogo (JP)

(72) Inventor: Hiroshi Abe, Kobe (JP)

(73) Assignee: Dunlop Sports Co. Ltd., Kobe (JP)

( * ) Notice: Subject to any disclaimer, the term of this patent is extended or adjusted under 35 U.S.C. 154(b) by 51 days.

(21) Appl. No.: 13/944,041

(22) Filed: Jul. 17, 2013

(65) Prior Publication Data

US 2014/0038745 A1 Feb. 6, 2014

(30) Foreign Application Priority Data

Jul. 31, 2012 (JP) ..... 2012-169145

(51) Int. Cl.
*A63B 53/04* (2006.01)
*A63B 49/06* (2006.01)

(52) U.S. Cl.
CPC ..... *A63B 53/0466* (2013.01); *A63B 2053/0458* (2013.01); *A63B 49/06* (2013.01); *A63B 2053/0408* (2013.01); *A63B 2053/0433* (2013.01); *A63B 2053/0437* (2013.01); *A63B 2053/0462* (2013.01)

(58) Field of Classification Search
CPC ..... A63B 53/0466; A63B 2053/0458; A63B 49/06; A63B 2053/0408; A63B 2053/0433; A63B 2053/0437; A63B 2053/0462
USPC ..... 473/324–350, 287–292
See application file for complete search history.

(56) References Cited

U.S. PATENT DOCUMENTS

| | | | | |
|---|---|---|---|---|
| 6,042,486 | A * | 3/2000 | Gallagher | 473/329 |
| 6,348,013 | B1 * | 2/2002 | Kosmatka | 473/329 |
| 7,582,024 | B2 * | 9/2009 | Shear | 473/329 |
| 2011/0218053 | A1 * | 9/2011 | Tang et al. | 473/349 |
| 2012/0142447 | A1 * | 6/2012 | Boyd et al. | 473/329 |

FOREIGN PATENT DOCUMENTS

| | | | |
|---|---|---|---|
| JP | 2002-52099 | A | 2/2002 |
| JP | 2003-210621 | A | 7/2003 |
| JP | 2003-210627 | A | 7/2003 |
| JP | 2009-56060 | A | 3/2009 |

* cited by examiner

*Primary Examiner* — Sebastiano Passaniti
(74) *Attorney, Agent, or Firm* — Birch, Stewart, Kolasch & Birch, LLP

(57) ABSTRACT

A hollow golf club head comprises a face and a face peripheral portion extending rearward from the face, the face periphery portion provided with a toe-side reduced-rigidity portion and a heel-side reduced-rigidity portion consisting of a concave portion or a slit, wherein under a standard state, the toe-side portion has a center point of length located higher and at the toe side than a face centroid, wherein an angle of a first straight line passing through the face centroid and the center point P1 to the horizontal plane is 20 to 60 degrees, and the heel-side portion has a center point P2 of length located lower and the heel side than the face centroid, wherein an angle of a second straight line passing through the face centroid and the center point P2 to the horizontal plane is 10 to 70 degree.

9 Claims, 11 Drawing Sheets

E1 Cross section

GOLF CLUB HEAD

BACKGROUND OF THE INVENTION

1. Field of the Invention

The present invention relates to a golf club head which efficiently improves resilience performance while minimizing degradation of durability.

2. Description of the Related Art

Japanese Patent Application laid-open No. 2009-56060 discloses a hollow golf club head comprising a sole, and a face including a thinner portion formed in an area on a lower side of the face that includes a corner between the face and the sole portion. In this application, however, adequate consideration to an area in a toe-heel direction where the thinner portion is provided has not been given. Therefore, the head mentioned above may have significantly degraded durability.

Japanese Patent Application laid-open No. 2002-52099 discloses a golf club head having a face and a head body provided with a bend portion that extends along a periphery of the face and reaches inside of the head. In this application, however, adequate consideration to an area in a toe-heel direction where the bend portion is provided has not been given, either. Therefore, the head mentioned above may also have significantly degraded durability.

Japanese Patent Application laid-open No. 2003-210621 discloses a golf club head comprising a face and a main body provided with slits on its crown and sole sides around the face that extend along a periphery of the face. In this application, however, adequate consideration to an area in a toe-heel direction where the slits are provided has not been given, either. Therefore, the head mentioned above may have significantly degraded durability.

Japanese Patent Application laid-open No. 2003-210627 discloses a golf club head comprising a face and amain body provided with a thinner portion on its crown or sole portions on the side of the face. In this application, however, adequate consideration to an area in a toe-heel direction where the thinner portion is provided has not been given, either. Therefore, the head mentioned above may have significantly degraded durability.

SUMMARY OF THE INVENTION

The present invention has been made in light of the current conditions described above, and a primary object of the present invention is to provide a golf club head that efficiently improves resilience performance, while minimizing degradation of durability.

In accordance with the present invention, there is provided a hollow golf club head comprising a face for hitting a ball having a periphery and a face centroid, and a face peripheral portion extending rearward of the head from the periphery of the face and provided with a plurality of reduced-rigidity portions, said each reduced-rigidity portions consisting of a concave portion or a slit each of which extends along the periphery of the face, wherein in a standard state in which the head is placed on a horizontal plane so that a centerline of a shaft axis of the head is inclined at its lie angle within a vertical plane and the face is held at its loft angle, the reduced-rigidity portions consist of a toe-side reduced-rigidity portion provided on the toe side than the face centroid and a heel-side reduced-rigidity portion provided on the heel side than the face centroid, and when the head in the standard state is viewed from a direction of a normal of the face centroid, said toe-side reduced-rigidity portion has a center point P1 of its length located higher and at the toe side than the face centroid, wherein an angle θt of a first straight line connecting the face centroid with the center point P1 of the toe-side reduced-rigidity portion with respect to the horizontal plane is in a range of from 20 to 60 degrees, and the heel-side reduced-rigidity portion has a center point P2 of its length located lower and the heel side than the face centroid, wherein an angle θh of a second straight line connecting the face centroid with the center point P2 of the heel-side reduced-rigidity portion with respect to the horizontal plane is in a range of from 10 to 70 degree.

Preferably, the head comprises a cup-shaped face member having the face and a flange portion which extends rearward of the head from the periphery of the face to constitute the face peripheral portion, and a head main body fixed to a rear side of the face member.

Preferably, each reduced-rigidity portion has a longitudinal length in a range of from 5 to 60 mm and a width perpendicular to the longitudinal direction thereof is in a range of from 0.2 to 3.0 mm.

Preferably, reduced-rigidity portions comprise at least one said concave portion provided on the side of a hollow of the head and having a depth in a range of from 0.2 to 1.0 mm in a cross section perpendicular to a longitudinal direction of the concave portion.

Preferably, reduced-rigidity portions comprise at least one said concave portion provided on the side of a hollow of the head and having a smooth curved shape in a cross section perpendicular to the longitudinal of the concave portion.

Preferably, reduced-rigidity portions comprise at least one said concave portion provided on the side of a hollow of the head so as to include a corner formed between the face peripheral portion and the face, in a cross section perpendicular to the longitudinal direction of the concave portion.

Preferably, reduced-rigidity portions comprise at least one said slit which penetrates the face peripheral portion and has a width perpendicular to the longitudinal direction of the slit in a range of from 0.5 to 1.5 mm.

Preferably, the face peripheral portion is an area within 10 mm from the periphery of the face to the rearward of the head.

Preferably, the angle θt of the first straight line is in a range of from 30 to 45 degrees and the angle θh of the second straight line is in a range of from 30 to 50 degrees.

DESCRIPTION OF THE PREFERRED EMBODIMENTS

An embodiment of the present invention will be explained below with reference to the accompanying drawings.

Figure 1:
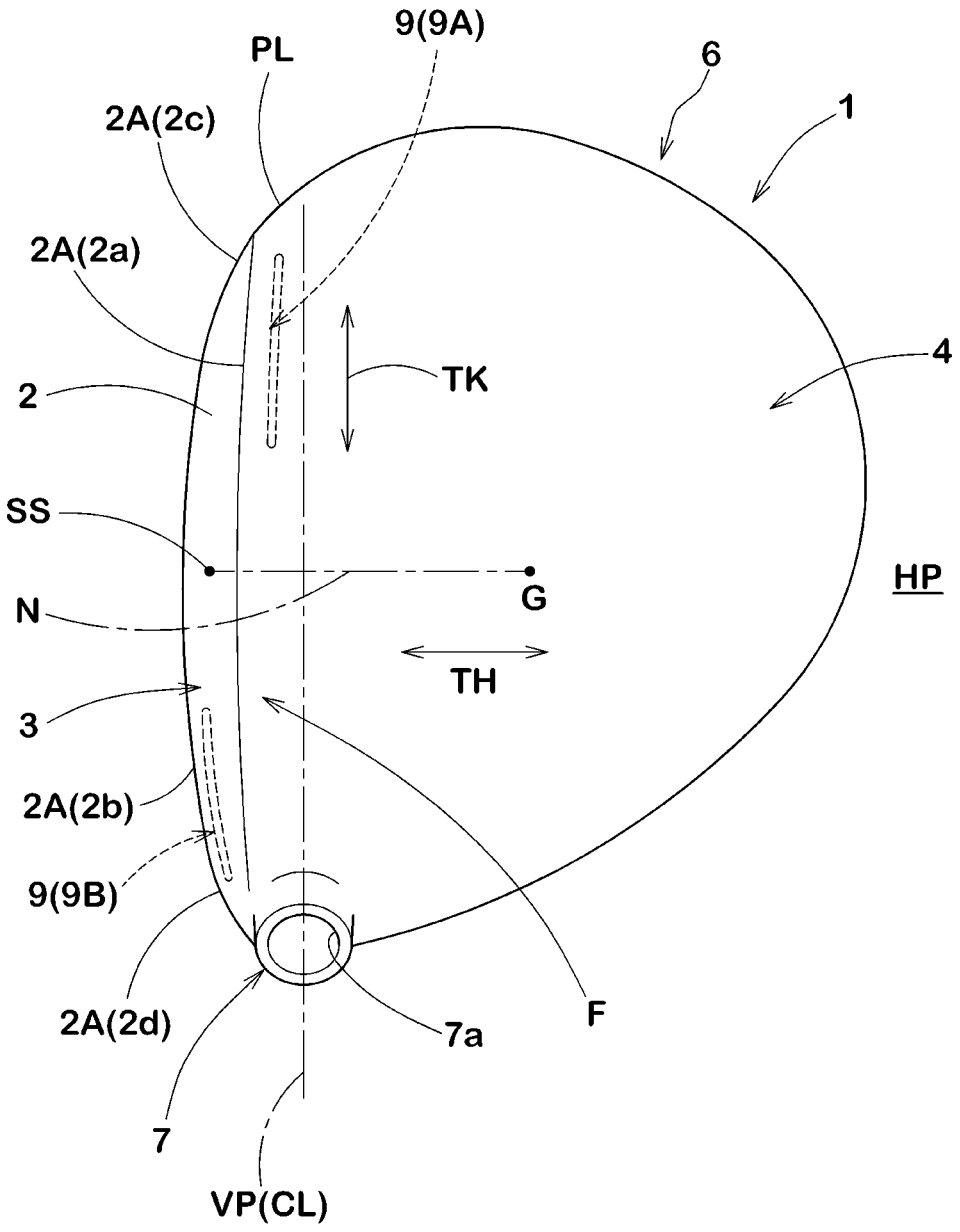
FIG. 1 is a plan view of a golf club head in a standard state according to an embodiment of the present invention.
Figure 2:
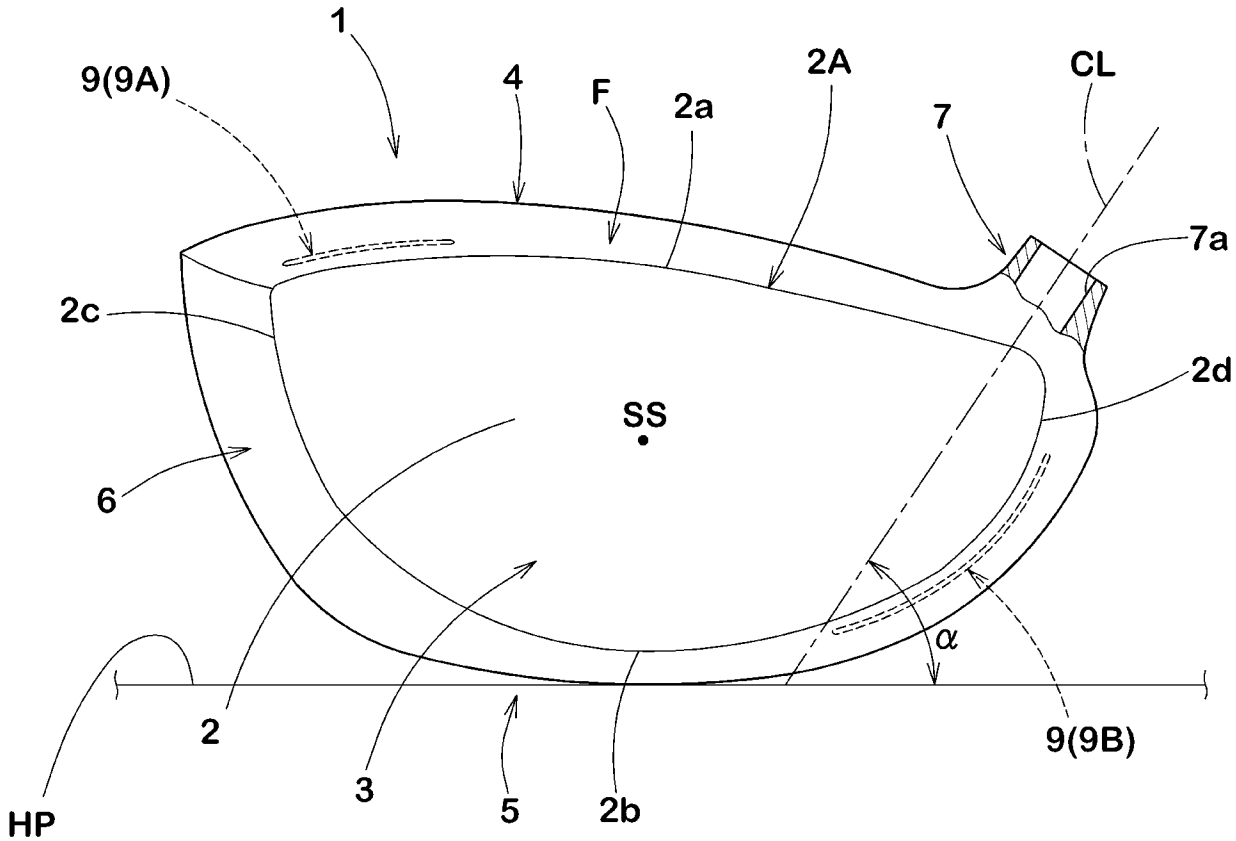
FIG. 2 is a front view of the golf club head of FIG. 1.

FIGS. 1 and 2 show a golf club head (which may be hereinafter simply referred to as a "head" or "club head") 1 of the embodiment under a standard state.

Here, the standard state of the head 1 is a state in which the head 1 is placed on a horizontal plane HP so that a centerline CL of a shaft axis of the head is inclined at its lie angle α within a vertical plane VP and a face 2 thereof is held at its loft angle (a face angle being set to zero). Unless otherwise noted, the club head 1 shall be in the standard state. Note that the loft angle is given as an angle equal to or greater than 0 degree. In case that the face 2 has a vertical face roll, the loft angle is measured as an angle of a tangent line passing through a sweet spot SS of the face 2.

In the specification, as shown in FIG. 1, a front-back direction of the head 1 is defined as a direction "TH" parallel to a normal N to the face 2 that extends from a center G of gravity of the head, in a planar view under the standard state. A toe-heel direction of the head 1 is defined as a direction "TK" perpendicular to the normal N in the planar view mentioned above. An intersection of the normal N and the face 2 is defined as the sweet spot 55.

The head 1 comprises a face portion 3, a crown portion 4, a sole portion 5, a side portion 6, and a hosel portion 7. The face portion 3 has the face 2 for hitting a ball.

The crown portion 4 is connected to an upper edge 2*a* of the face 2 so as to constitute a top surface of the head. The sole portion 5 is connected to a lower edge 2*b* of the face 2 so as to constitute a bottom surface of the head. The side portion 6 connects between the crown portion 4 and the sole portion 5 which extends from a toe-side edge 2*c* of the face 2 to a heel-side edge 2*d* of the face 2 through the rearward of the head. The hosel portion 7 is provided on the heel side of the crown portion 4. The hosel portion 7 is formed like a cylindrical shape having a shaft insertion hole 7*a* into which an end of a golf club shaft (not shown) is inserted.

The golf club is constructed by attachment of the golf club shaft to the shaft insertion hole 7*a* of the hosel portion 7 (all not shown). In case that the shaft is not mounted to the club head 1, a centerline of the shaft insertion hole 7*a* is regarded as the centerline CL of the shaft axis.

Figure 3A:
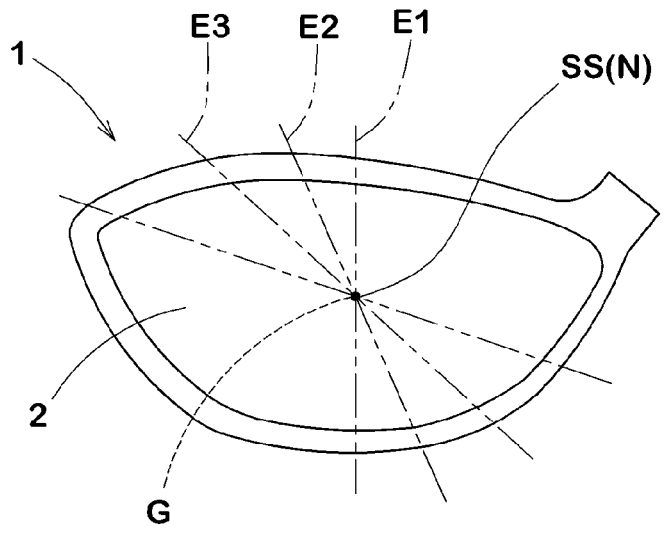
FIG. 3A is a front view of the golf club head.
Figure 3B:
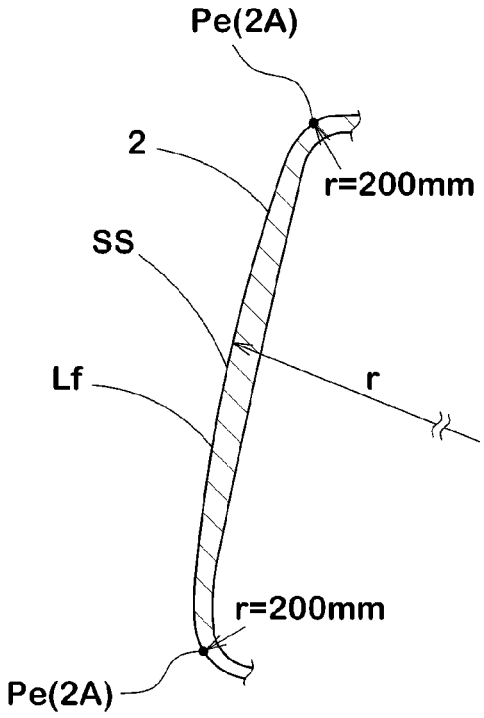
FIG. 3B is a cross sectional view taken along a line E1 in FIG. 3A.

The face 2 is defined as an area surrounded by its periphery 2A consisting of the upper edge 2*a*, the toe-side edge 2*c*, the lower edge 2*b*, and the heel-side edge 2*d*. In case that a recognizable periphery edge in appearance exists on the head, the periphery 2A of the face 2 is defined as the edge. In case that no recognizable periphery edge exists, the periphery 2A of the face 2 is defined as follows. Referring to FIGS. 3A and 3B, in each cutting plane E1, E2, E3 that includes the normal line N extending between the sweet spot SS and the center G of gravity of the head, as shown in FIG. 3A, a point Pe at which the radius (r) of curvature of a profile line Lf of the face 2 becomes under 200 mm in the course from the sweet spot SS to the periphery 2A of the club face is determined. Then, the virtual edge line is defined as a locus of the points Pe.

The head 1 in accordance with the present embodiment is configured as a wood type having a hollow "i" (shown in FIG. 4) provided therein. A concept of a wood-type golf club head is such that it includes at least Driver (#1), Brassy (#2), Spoon (#3), Baffy (#4), and Cleek (5), and also includes heads which differ from them in the count number or a name but has an almost similar shape thereto.

Although no specific limitation is set on volume of the head 1, in the case of a driver, it is preferably set in a range of not less than 350 $cm^3$, more preferably not less than 420 $cm^3$. In addition, in the case of a fairway wood having its count number of #2 or higher, the volume of the head 1 is preferably set in a range of not less than 90 $cm^3$, more preferably not less than 120 $cm^3$. Such a head with large volume helps to provide a large moment of inertia and a deeper head center of gravity. Since too large volume of the head 1 leads to problems such as increased weight of the head, lack of swing balance, and a violation of golf regulations and the like, the volume of the head 1 is preferably in a range of not more than 460 $cm^3$.

There is a tendency that if weight of the head 1 is too small, kinetic energy of the head is small and improvement in a flight distance cannot be expected. To the contrary, there is a tendency that if weight of the head is too large, swinging becomes difficult and directional stability or a flight distance of a hit ball degrades. From such a point of view, in the case of a driver, weight of the head 1 is preferably in a range of not less than 160 g and more preferably not less than 170 g, but preferably not more than 220 g, more preferably not more than 210 g. In the case of a fairway wood, weight of the head 1 is preferably set in a range of not less than 180 g, more preferably not less than 190 g, but preferably not more than 250 g, more preferably not more than 240 g.

Figure 4:
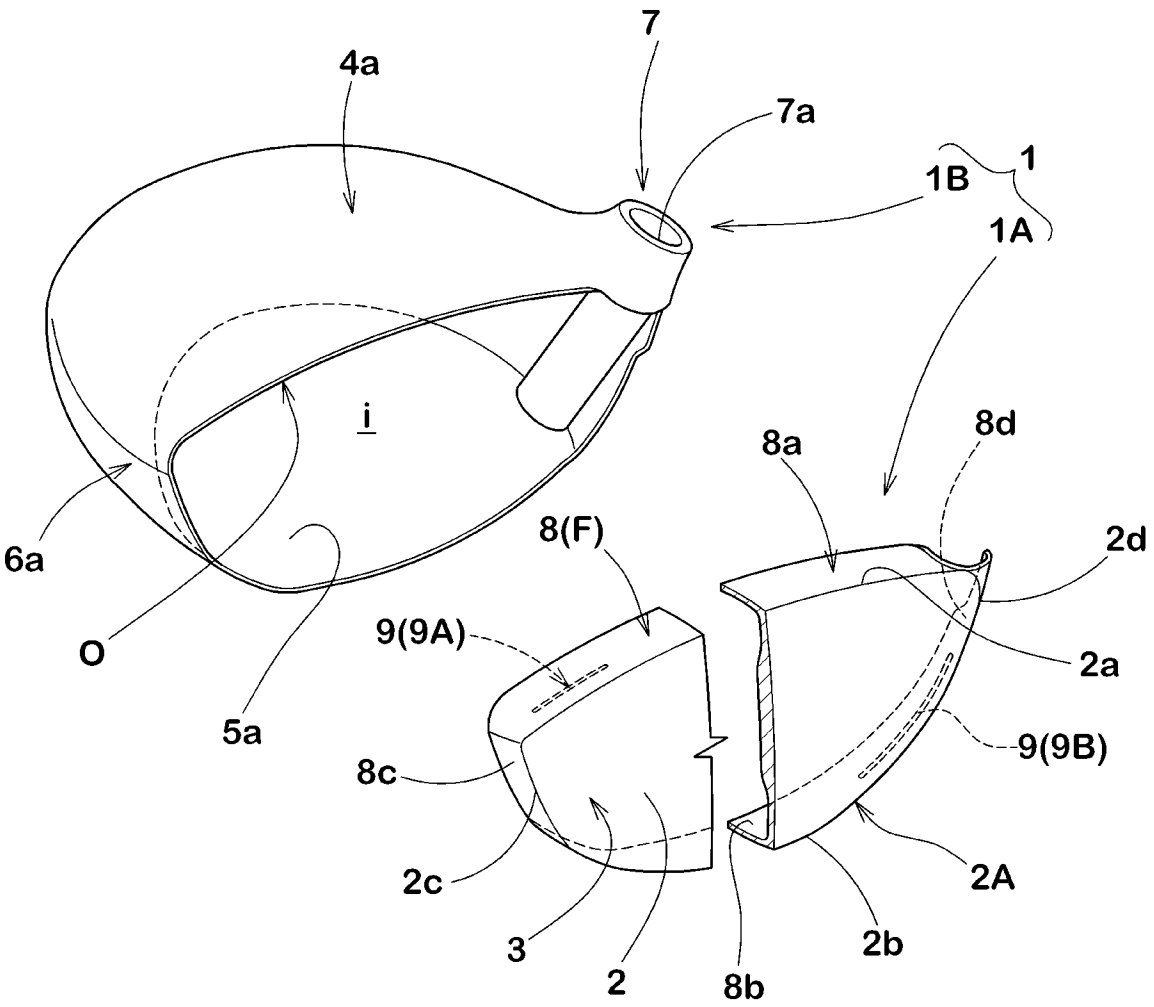
FIG. 4 is an exploded perspective view of the golf club head of FIG. 1.

As shown in FIG. 4, the head 1 in accordance with the embodiment comprises a face member 1A including at least a part (all in the embodiment) of the face portion 3 and a head main body 1B fixed to a rear side of the face member 1A.

The face member 1A of this embodiment has a cup shape including the face 2 and a flange portion 8 extending from the periphery 2A of the face 2 to the rearward of the head. The face member 1A is made of a metal material to ensure its durability. Although no specific limitation is set on the metal material, it is desirably stainless alloy having large specific intensity, maraging steel, titanium, titanium alloy, magnesium alloy, or aluminum alloy, in particular.

The head main body 1B includes a portion excluding the face member 1A from the club head 1, namely, a crown rear section 4*a*, a sole rear section 5*a*, a side rear section 6*a*, and the hosel portion 7. The crown rear section 4*a* forms a rear section of the crown portion 4. The sole rear section 5*a* forms a rear section of the sole portion 5. The side rear section 6*a* forms a rear section of the rear portion 6. The head main body 1B also has an opening O on its front for attaching the face member 1A.

As a material for the head main body 1B, metal materials such as stainless steel, maraging steel, titanium alloy, aluminum alloy, or magnesium alloy, and the like, for example, are preferred. The head main body 1B may be partially formed of a non-metal material such as fiber reinforced resin having small specific gravity. In addition, a weight member and the like having large specific gravity may be fixed to the head main body 1B (not shown).

In this embodiment, the head main body 1B and the face member 1A are fixed by welding. Since the welding position is away from the periphery 2A of the face 2 rearwardly, weld beads remaining on the hollow "i" of the head 1 do not excessively increase rigidity of the face portion 3 and therefore can prevent degradation of resilience performance.

Figure 5A:
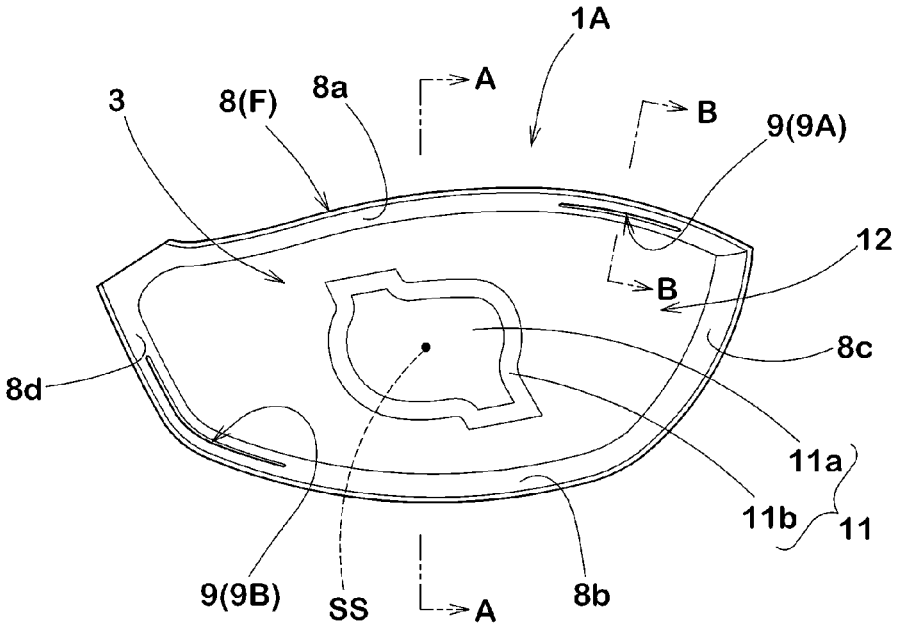
FIG. 5A is a rear view of a face member in the golf club head of FIG. 1.
Figure 5B:
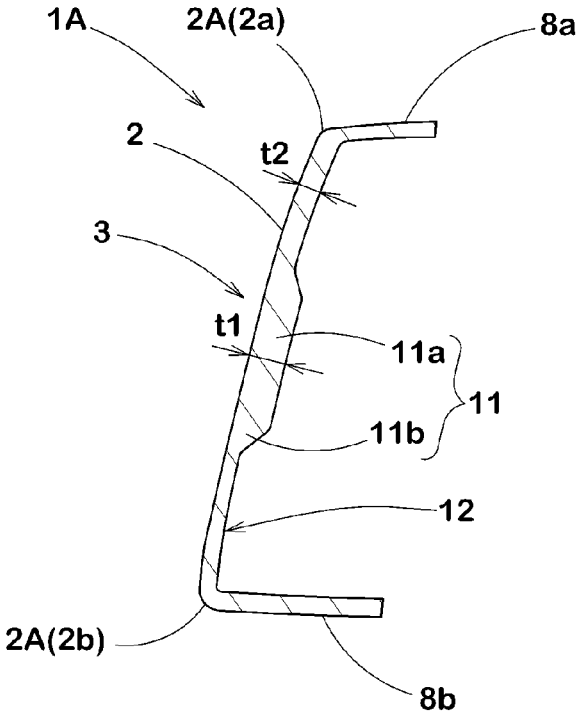
FIG. 5B is a cross sectional view taken along a line A-A in FIG. 5A.

FIG. 5A shows a rear view of the face member 1A, and FIG. 5B shows a cross sectional taken along a line A-A in FIG. 5A. As shown in FIGS. 5A and 5B, the face portion 3 has a central thick part 11 provided substantially center of the face 2 and a peripheral thin part 12 having a thickness smaller than that of the central thick part 11.

The central thick part 11 of the face portion 3 includes a main part 11*a* having a constant thickness and a transitional part 11*b* connecting between the main part 11*a* and the peripheral thin part 12 so that a thickness thereof gradually decreases toward the peripheral thin part.

The main part 11*a* of the central thick part 11 has the largest thickness t1 in the face portion 3. Preferably, the main part 11*a* includes the sweet spot SS of the face 2. This improves strength of the sweet spot SS where is a main hitting position of the face 2. Although no specific limitation is set on the thickness t1 of the main part 11*a*, there is a possibility that durability easily degrades when the thickness t1 is small, and that improvement of resilience performance cannot be expected when the thickness t1 is large. From such a point of view, the thickness t1 of the main part 11*a* is preferably in a range of not less than 2.8 mm, more preferably not less than 3.0 mm, but preferably not more than 4.0 mm, more preferably not more than 3.8 mm.

The peripheral thin part 12 of the face portion 3 in accordance with the present embodiment has the smallest and substantially constant thickness t2 in the face portion 3. The peripheral thin part 12 makes the face 2 flexible, increases resilience performance, and improves a flight distance of a hit ball. Although no specific limitation is set on the thickness t2 of the peripheral thin part 12, there is a possibility that durability easily degrades when the thickness t2 is small, and that improvement of resilience performance cannot be expected when the thickness t2 is large. From such a point of view, the thickness t2 of the peripheral thin part 12 is preferably in a range of not less than 1.5 mm, more preferably not less than 1.7 mm, but preferably not more than 2.5 mm, more preferably not more than 2.3 mm.

As shown in FIG. 4, the flange portion 8 of the face member 1A includes a crown-side flange portion 8*a* forming the front side of the crown portion 4, a sole-side flange portion 8*b* forming the front side of the sole portion 5, a toe-side flange portion 8*c* forming the toe side of the side portion 6, and the heel-side flange portion 8*d* forming the heel side of the side portion 6. Each of flange portions 8*a* to 8*d* annularly continues around the face 2. The flange portion 8 constitutes a face peripheral portion F which extends from the periphery of the face 2 to the rearward of the head.

Figure 6:
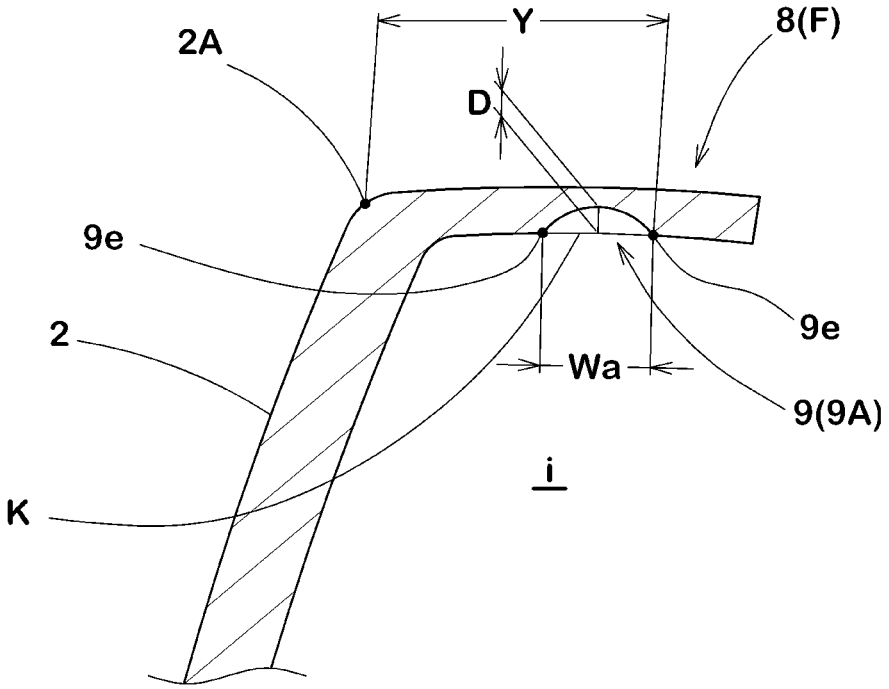
FIG. 6 is an enlarged cross sectional view taken along a line B-B in FIG. 5A.

As shown in FIGS. 1, 2, and 5A, the face peripheral portion F is provided with a plurality reduced-rigidity portions 9 each of which extends along the periphery 2A of the face 2. FIG. 6 shows a cross sectional view taken along a line B-B in FIG. 5A. Referring to FIG. 6, each reduced-rigidity portion 9 of this embodiment is provided on the side of the hollow part "i" of the head and consists of a groove-like concave portion extending along the periphery 2A of the face 2. Since the face peripheral portion F with the reduced-rigidity portion 9 has small flexural rigidity, it may greatly deform due to impact when hitting a ball. Such a head 1 produces a spring effect that conveys large restoring force of deformation to a ball. Therefore, the golf club head 1 in accordance with the present invention has the improved resilience performance.

The reduced-rigidity portion 9 "extending along the periphery 2A of the face 2" means that a longitudinal direction of the reduced-rigidity portion 9 may be a direction along the periphery 2A of the face 2, and does not necessarily require that the reduced-rigidity portion 9 extends in parallel to the periphery 2A of the face 2.

Figure 7:
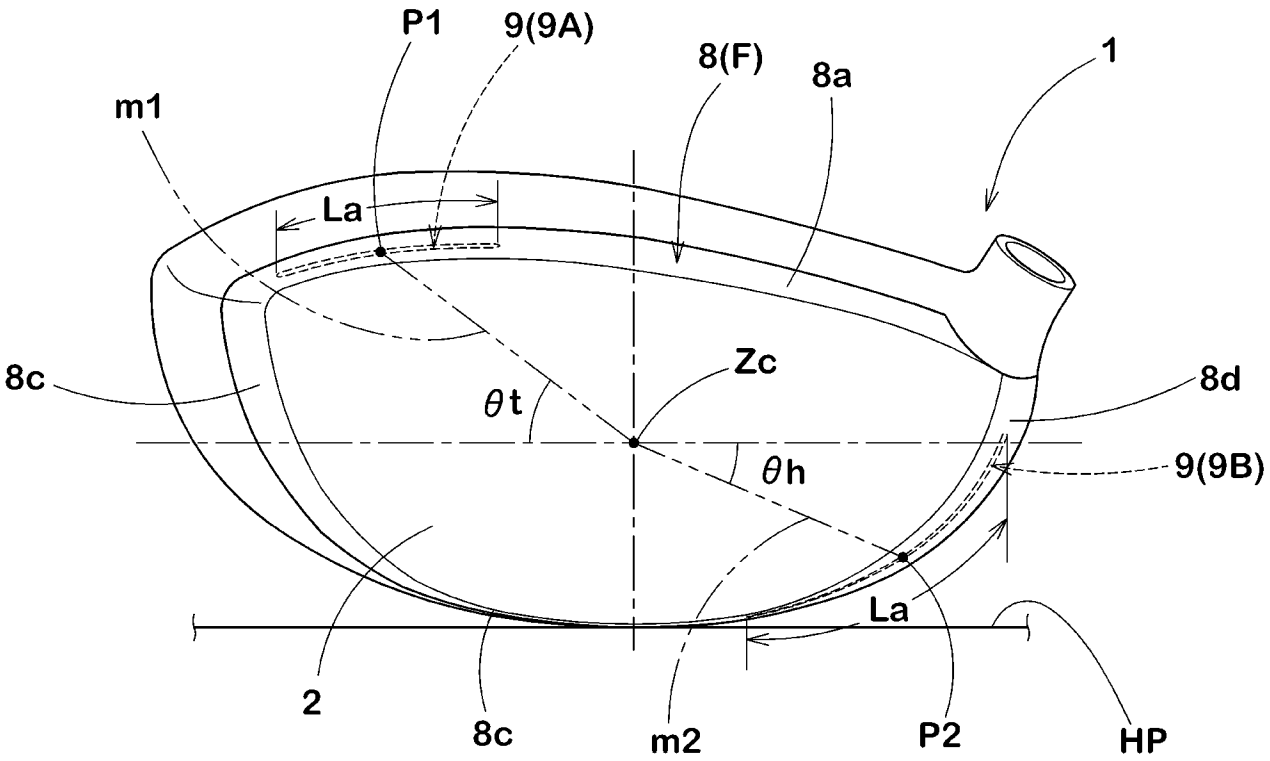
FIG. 7 is a front view of the golf club head of FIG. 1 viewed from a direction of a normal on its face centroid.

FIG. 7 shows the head 1 under the standard state when it is viewed from a direction of a normal line passing through a face centroid Zc of the face 2. As shown in FIG. 7, the reduced-rigidity portions 9 of the embodiment consist of a toe-side reduced-rigidity portion 9A and a heel-side reduced-rigidity portion 9B. The toe-side reduced-rigidity portion 9A is provided in its entirety on the toe side than the face centroid Zc of the face 2. The heel-side reduced-rigidity portion 9B is provided in its entirety on the heel side than the face centroid Zc of the face 2. The reduced-rigidity portions 9A and 9B are provided without being connected to each other. Additionally, only two reduced-rigidity portions 9A and 9B mentioned above are provided on the face peripheral portion F in this embodiment.

In the present invention, each location of the toe-side and heel-side reduced-rigidity portions 9A, 9B is determined to a certain range, as described below. This may provide a head 1 which efficiently improves resilience performance while minimizing degradation of durability.

Figure 8:
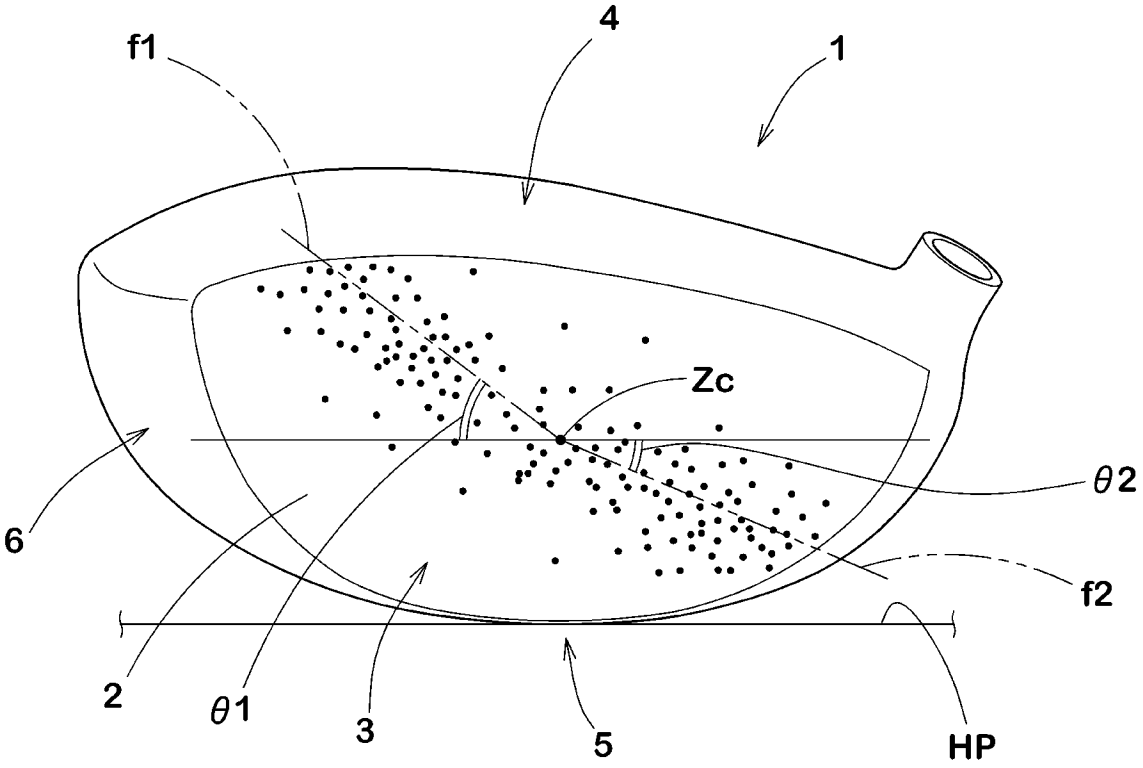
FIG. 8 is a front view of the golf club head of FIG. 7 showing hit positions of average golfers.

FIG. 8 shows a front view of the club head that shows main hitting points of average golfers using black dots obtained through experiments of the inventor. Additionally, FIG. 8 shows the head 1 viewed from a direction of a normal line passing through the face centroid Zc, wherein the normal line is arranged in parallel to the horizontal plane HP. Although the hitting points of average golfers are scattered, these points are almost concentrated in an area which is inclined right downward from the toe-crown side to the heel-sole side of the face 2.

In FIG. 8, for the hitting points located on the toe side than the face centroid Zc and the hitting points located on the heel side than the face centroid Zc of the face 2, approximate straight lines f1 and f2 which respectively pass through the face centroid Zc are shown. Angles θ1 and θ2 of the approximate straight lines f1 and f2 with respect to the horizontal line are, respectively, about 40 degrees. Such approximate straight lines f1 and f2 have the smallest distance from each hitting points on the toe side and the heel side, respectively, and are considered to represent main hit points of the average golfers.

Additionally, the hitting points located on the toe side than the face centroid Zc of the face 2 are distributed in the range of about 20 degrees on both sides of the approximate straight line f1 as a center. On the other hand, the hitting points located on the heel side than the face centroid Zc of the face 2 are distributed in the range of about 30 degrees on both sides of the approximate straight line f2 as a center.

On the basis of the distribution of hitting points of such average golfers, the reduced-rigidity portions 9 in the present invention are provided in an area that provides the most efficiently flexure with the head 1 when hitting a ball. Specifically, as shown in FIG. 7, the toe-side reduced-rigidity portion 9A has a center point P1 of its length La located higher and at the toe side than the face centroid Zc, wherein an angle θt of a first straight line m1 connecting the face centroid Zc with the center point P1 of the toe-side reduced-rigidity portion 9A with respect to the horizontal plane HP is in a range of from 20 to 60 degrees. If there are a plurality of reduced-rigidity portions 9 within the toe side, all of them satisfy provisions of the angle θt. In such a head 1, if a ball is hit on the first straight line m1 on the toe side than the face centroid Zc, the toe-side reduced-rigidity portion 9A effectively works and large flexure of the head 1 can be achieved.

Similarly, in FIG. 7, the heel-side reduced-rigidity portion 9B has a center point P2 of its length La located lower and at the heel side than the face centroid Zc, wherein an angle θh of a second straight line m2 connecting the face centroid Zc with the center point P2 of the heel-side reduced-rigidity portion 9B with respect to the horizontal plane HP is in a range of from 10 to 70 degree. If there are a plurality of reduced-rigidity portions 9 within the heel side, all of them satisfy provisions of the angle θh. With such a head 1, if a ball is hit on the second straight line m2 on the heel side than the face centroid Zc, the heel-side reduced-rigidity portion 9B effectively works and large flexure of the head 1 can be also achieved.

Then, since the first straight line m1 and the second straight line m2 are considered the main hitting points of average golfer, the club head 1 of the present invention can efficiently flex the face 2 or the head 1, thereby improving the resilience performance even when a ball is hit at the toe-side area or the heel-side area. Additionally, the reduced-rigidity portions 9 can effectively reduce rigidity of the toe-crown area and heel-sole area of the face peripheral portion F, which correspond to positions that average golfers hit highly frequently. Therefore, the club head 1 of the present invention minimizes degradation of durability, and achieves large flexure of the head at highly frequently hit points, thus being able to efficiently improve the resilience performance.

In order to produce the above-mentioned advantage more effectively, the angle θt of the first straight line m1 to the horizontal plane HP is preferably in a range of from 30 to 45 degrees. Similarly, the angle θh of the second straight line m2 to the horizontal plane HP is preferably in a range of from 30 to 50 degrees. Note that the range of the angle θh of the second straight line m2 of 10 to 70 degrees is made greater than the range of the angle θt of the first straight line m1 of 20 to 60 degrees so as to correspond to the fact that, as shown in FIG. 8, the range of distribution of the hitting points on the heel side is larger than the range of distribution of the hitting points on the toe side.

In order to further prevent degradation of durability of the head 1, it is desirable that the toe-side reduced-rigidity portion 9A is formed only in the crown-side flange portion 8, not formed in the toe-side flange portion 8*c*. Note that, as shown in FIG. 1, a border between the crown-side flange portion 8*a* and the toe-side flange portion 8*c* is defined by a head contour PL which appears on the toe side when the head 1 in the standard state is in a planar view. Similarly, it is desirable that the heel-side reduced-rigidity portion 9B is provided on the heel-side flange portion 8*d* or the sole-side flange portion 8*b*, and formed without extending to the crown-side flange portion 8*a*. Note that a border between the crown-side flange portion 8*a* and the heel-side flange portion 8*d* is also defined by the head contour PL which appears on the heel side when the head 1 in the standard state is in planar view, as shown in FIG. 1.

In FIG. 7, each length La of the toe-side reduced-rigidity portion 9A or the heel-side reduced-rigidity portion 9B is preferably set in a range of not less than 5 mm, more preferably not less than 20 mm, but preferably not more than 60 mm, more preferably not more than 40 mm. There is a possibility that the advantage of improving the resilience performance of the face 2 may not be sufficiently achieved when the length La of the reduced-rigidity portion 9A or 9B is less than 5 mm. To the contrary, there is a possibility that durability of the head 1 may degrade when the length La of the reduced-rigidity portion 9A or 9B exceeds 60 mm. Note that each length La of the reduced-rigidity portion 9A or 9B is defined as a length being projected on a plane at right angle to the normal passing through the face centroid Zc of the face 2.

As shown in FIG. 6, each width Wa of the reduced-rigidity portion 9A or 9B perpendicular to the longitudinal direction thereof is preferably in a range of not less than 0.2 mm, more preferably not less than 0.5 mm, but preferably not more than 3.0 mm, more preferably not more than 2.0 mm. There is a possibility that the advantage of improving the resilience performance may not be sufficiently achieved when the width Wa of the reduced-rigidity portion 9A or 9B is less than 0.2 mm. To the contrary, there is a possibility that durability of the head 1 may degrade when the width Wa of the reduced-rigidity portion 9A or 9B exceeds 3.0 mm. The width Wa of the reduced-rigidity portion 9 shall be length of a straight line K connecting both ends 9*e* and 9*e* of the concave portion at a cross section perpendicular to the longitudinal direction of the reduced-rigidity portion 9.

Depth D of the reduced-rigidity portion 9A or 9B is preferably in a range of not less than 0.2 mm, more preferably not less than 0.5 mm, but preferably not more than 1.0 mm, and more preferably not more than 0.9 mm. There is a possibility that if the depth D of the reduced-rigidity portion 9A or 9B is large, stress is easily concentrated on a bottom portion thereof, thus degrading durability. To the contrary, there is possibility that if the depth D is small, deformation of the head 1 starting from the bottom portion is small, thus degrading the resilience performance. Note that the depth D is measured as maximum measurement from the straight line K to a concave portion which is measured in a direction perpendicular to the straight line K.

As shown in FIG. 6, for the reduced-rigidity portion 9A or 9B, a contour of the cross section is formed by a smooth curve. A smooth curve includes a circular or U-shaped curve, and it is desirable that the curve does not have a sharp corner. The reduced-rigidity portion 9A or 9B of the embodiment is formed to have a circular cross section. The reduced-rigidity portion 9 consisting of such a concave portion prevents concentration of stress on a specific member in the concave portion and minimize degradation of durability of the head.

Preferably, the reduced-rigidity portion 9 is formed in an area Y which is within 10 mm from the periphery 2A of the face 2 to the rearward of the head. Specifically, it is desirable that the entire reduced-rigidity portion 9 fits in the area Y within 10 mm from the periphery 2A of the face 2 to the rearward of the head. If the reduced-rigidity portion 9 is far away from the periphery 2A of the face 2 to the rearward of the head, there is a possibility that large flexure of the head 1 cannot be easily achieved and the resilience performance may deteriorate.

Figure 9:
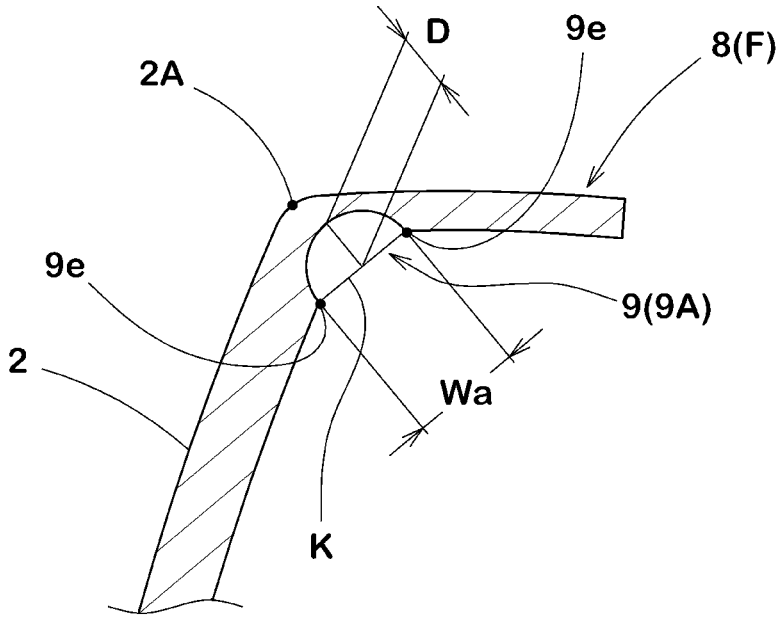
FIG. 9 is a cross sectional view showing other embodiment of a reduced-rigidity portion corresponding to a position taken along a line B-B in FIG. 5A.

FIG. 6 shows the reduced-rigidity portions 9 formed in the flange portion 8. As shown in FIG. 9, however, the reduced-rigidity portions 9 comprise a concave portion so as to include a corner formed between the face peripheral portion F and the face 2 in a cross section perpendicular to the longitudinal direction of the concave portion. Since such a reduced-rigidity portion 9 reduces rigidity of the face portion 3 more effectively, it can increase flexure of the face portion 3 when a ball is hit, thereby improving the resilience performance.

Figure 10:
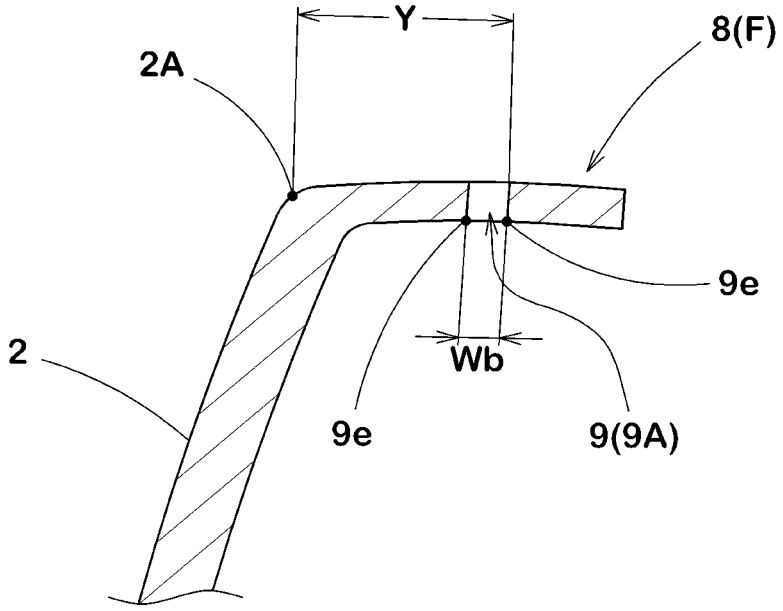
FIG. 10 is a cross sectional view showing other embodiment of a reduced-rigidity portion corresponding to a position taken along a line B-B in FIG. 5A.

In addition, each of the embodiments described above shows the head having the reduced-rigidity portion 9 formed by the groove-like concave portion. As shown in FIG. 10, however, the reduced-rigidity portion 9 may be formed as slits which penetrate the flange portion 8 of the face member 1A and extend along the periphery 2A of the face 2. If slits have same width, slits have a greater effect of reducing rigidity than the concave portion. Thus, if the reduced-rigidity portion 9 consists of slits, it is desirable that dimensions of longitudinal length and width thereof are made smaller than the dimension of the concave portion. Specifically, in case that the reduced-rigidity portion 9 is formed as the slit, the length La thereof is more preferably in a range of not less than 10 mm and more preferably not more than 30 mm. Additionally, the width Wa of the slit is preferably in a range of not less than 0.2 mm, more preferably not less than 0.5 mm, but more preferably not more than 1.5 mm.

Although the present invention has been described so far in detail, the present invention is not limited to the specific embodiments described above and may be changed to different aspects as needed.

Figure 12:
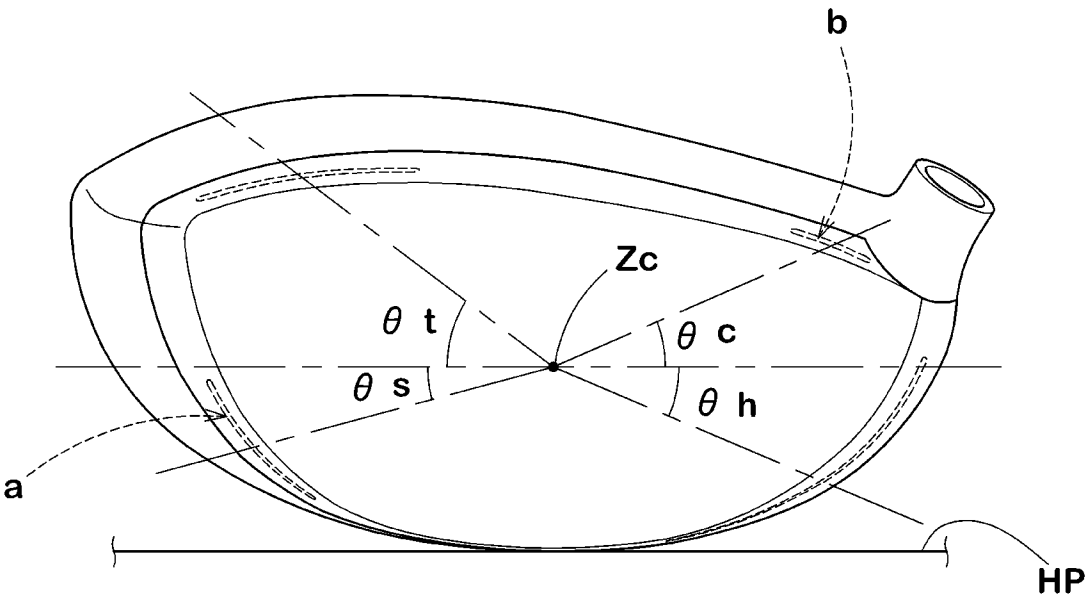
FIG. 12 is a view of the golf club head of Ref.5 viewed from a direction of a normal on its face centroid.

Comparative Test:

In order to confirm the advantageous effects of the present invention, wood-type golf club heads (drivers) based on the specifications in Tables 1 and 2 were made, on the premise of the configurations shown in FIG. 1, FIG. 2, FIG. 4, FIGS. 5A and 5B, FIG. 6, FIG. 7, and FIG. 10. In each examples and references, a reduced-rigidity portion was formed to fit within an area Y (see FIG. 6) of 5 mm from a periphery of the face to the rearward of the head. In addition, as shown in FIG. 12, two more reduced-rigidity portions "a" and "b" are added to only the head of Ref.5 (it has a total of four reduced-rigidity portions). Specifications of the added two reduced-rigidity portions are as follows:

Specifications of the Reduced-Rigidity Portion a:

Angle θs: 15.0 degrees width Wa: 1.0 mm

Length La: 35.0 mm

Depth D: 0.5 mm

Specifications of the Reduced-Rigidity Portion b:

Angle θc: 20.0 degrees width Wa: 1.0 mm

Length La: 10.0 mm

Depth D: 0.5 mm

A carbon shaft (SV-30203, Flex S) manufactured by Dunlop Sports Co., Ltd. was attached to each head under test to make a 45-inch wood-type club. Then, tests of the resilience performance and durability were conducted on each club.

Each head described above had a two-piece structure in which a head main body consisting of a lost-wax precision cast of Ti-6Al-4V and a cup-shaped face member consisting of a press mold of Ti-6Al-4V are fixed by laser welding. Each head had specifications which were all identical, excluding the parameters shown in Table 1. Main common specifications of each head are as follows:

Lie angle: 58 degrees

Loft angle: 10.5 degrees

Head volume: 455 $cm^3$

Head weight: 190 g

Figure 11:
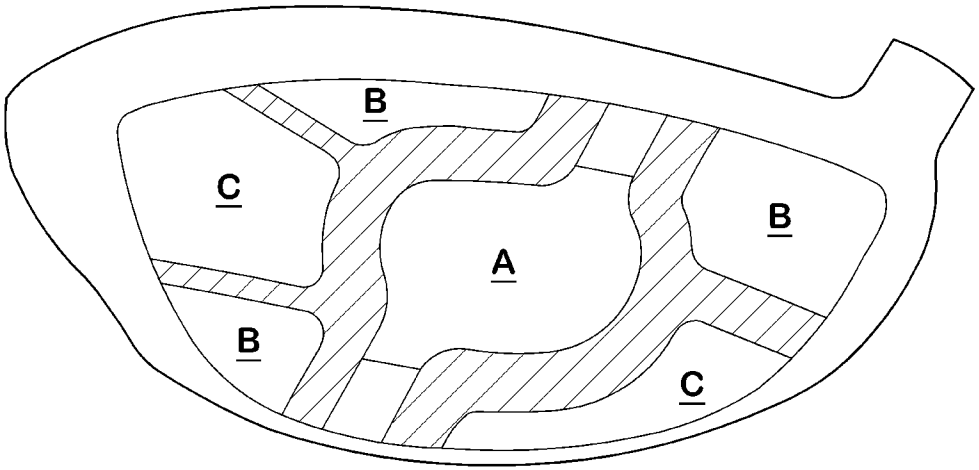
FIG. 11 is a front view of the head showing thickness distribution of the face portion of examples and references.

Thickness of the face portion: The face portion has the thickness distribution shown in FIG. 11.

Area A: 3.4 mm

Area B: 2.1 mm

Area C: 2.0 mm.

Thickness of a hatched part smoothly varies to thickness of areas connected at both sides thereof.

A method of testing is as follows:

Durability Test:

Each club under test described above was mounted to a swing robot manufactured by Miyamae Co., Ltd., and 3-piece golf balls ("XXIO XD" manufactured by Dunlop Sports Co., Ltd.) were repeatedly hit at the face centroid. The head speed was set to 54 m/s. Then, the head was observed with the naked eye for every 100 hit balls to see if there was any damage to the head, and the count of hit ball at which the damage was caused was examined. The result is the number of hits till the damage was discovered and shows that the larger a numeric value is, the better durability is. It can be stated that the club for which no damage was discovered till the number of hits reached 4,500 has adequate durability in practical use.

Resilience Performance Test:

Ten average golfers whose head speed with the driver described above is 35 to 45 m/s hit 10 balls of each of the balls described above, with the respective clubs under test. Then, the head speed "H.S" immediately before hitting and the initial speed of hit ball "B.S" were measured, and a ratio of the speed B.S/H.S was calculated. The result shows average values of the speed ratios of 10 hits, and the larger a numeric value is, the better the resilience performance is.

Table 1 shows test results, etc. of the heads having the reduced-rigidity portions consisting of the concave portions. Table 2 shows test results, etc. of the heads having the reduced-rigidity portions consisting of the slits.

TABLE 1

| | Toe-side reduced-rigidity portion | | | | Heel-side reduced-rigidity portion | | | | Resilience | Durability |
|---|---|---|---|---|---|---|---|---|---|---|
| | Width Wa (mm) | Length La (mm) | Depth D (mm) | Angle θt (°) | Width Wa (mm) | Length La (mm) | Depth D (mm) | Angle θh (°) | Performance (B.S/H.S) | (Number oh hits) |
| Ex. 1 | 1.0 | 35.0 | 0.5 | 20.0 | 1.0 | 35.0 | 0.5 | 40.0 | 1.42 | 6000 |
| Ex. 2 | 1.0 | 35.0 | 0.5 | 30.0 | 1.0 | 35.0 | 0.5 | 40.0 | 1.43 | 6200 |
| Ex. 3 | 1.0 | 35.0 | 0.5 | 35.0 | 1.0 | 35.0 | 0.5 | 10.0 | 1.42 | 6000 |
| Ex. 4 | 1.0 | 35.0 | 0.5 | 35.0 | 1.0 | 35.0 | 0.5 | 30.0 | 1.43 | 6200 |
| Ex. 5 | 1.0 | 35.0 | 0.5 | 35.0 | 1.0 | 35.0 | 0.5 | 40.0 | 1.44 | 6200 |
| Ex. 6 | 2.0 | 35.0 | 1.0 | 35.0 | 2.0 | 35.0 | 1.0 | 40.0 | 1.46 | 5800 |
| Ex. 7 | 3.0 | 35.0 | 1.0 | 35.0 | 3.0 | 35.0 | 1.0 | 40.0 | 1.48 | 5000 |
| Ex. 8 | 2.0 | 60.0 | 1.0 | 35.0 | 2.0 | 60.0 | 1.0 | 40.0 | 1.45 | 5300 |
| Ex. 9 | 1.0 | 35.0 | 0.3 | 35.0 | 1.0 | 35.0 | 0.3 | 40.0 | 1.41 | 6700 |
| Ex. 10 | 1.0 | 35.0 | 0.5 | 35.0 | 1.0 | 35.0 | 0.5 | 50.0 | 1.42 | 6000 |
| Ex. 11 | 1.0 | 35.0 | 0.5 | 35.0 | 1.0 | 35.0 | 0.5 | 70.0 | 1.45 | 5500 |
| Ex. 12 | 1.0 | 35.0 | 0.5 | 45.0 | 1.0 | 35.0 | 0.5 | 40.0 | 1.44 | 6200 |
| Ex. 13 | 1.0 | 35.0 | 0.5 | 60.0 | 1.0 | 35.0 | 0.5 | 40.0 | 1.41 | 6300 |
| Ex. 14 | 0.2 | 35.0 | 1.0 | 35.0 | 0.2 | 35.0 | 1.0 | 40.0 | 1.4 | 6200 |
| Ex. 15 | 2.0 | 5.0 | 1.0 | 35.0 | 2.0 | 5.0 | 1.0 | 40.0 | 1.4 | 6300 |
| Ex. 16 | 2.0 | 35.0 | 0.2 | 35.0 | 2.0 | 35.0 | 0.2 | 40.0 | 1.39 | 6500 |
| Ref. 1 | 1.0 | 35.0 | 0.5 | 10.0 | 1.0 | 35.0 | 0.5 | 40.0 | 1.38 | 6300 |
| Ref. 2 | 1.0 | 35.0 | 0.5 | 70.0 | 1.0 | 35.0 | 0.5 | 40.0 | 1.37 | 4200 |
| Ref. 3 | 1.0 | 35.0 | 0.5 | 35.0 | 1.0 | 35.0 | 0.5 | 5.0 | 1.37 | 5300 |
| Ref. 4 | 1.0 | 35.0 | 0.5 | 35.0 | 1.0 | 35.0 | 0.5 | 80.0 | 1.36 | 4000 |
| Ref. 5* | 1.0 | 35.0 | 0.5 | 35.0 | 1.0 | 35.0 | 0.5 | 40.0 | 1.45 | 3200 |

*Ref. 5 is shown in FIG. 12 that is added two reduced-rigidity portions a and b.

TABLE 2

| | Toe-side reduced-rigidity portion | | | | Heel-side reduced-rigidity portion | | | | Resilience | Durability |
|---|---|---|---|---|---|---|---|---|---|---|
| | Width Wa (mm) | Length La (mm) | Depth D (mm) | Angle θt (°) | Width Wa (mm) | Length La (mm) | Depth D (mm) | Angle θh (°) | Performance (B.S/H.S) | (Number of hits) |
| Ex. 17 | 1 | 20 | — | 35 | 1 | 20 | — | 40 | 1.44 | 5500 |
| Ex. 18 | 3 | 50 | — | 35 | 3 | 50 | — | 40 | 1.48 | 4800 |
| Ex. 19 | 0.5 | 10 | — | 35 | 0.5 | 10 | — | 40 | 1.42 | 6000 |
| Ex. 20 | 3 | 50 | — | 20 | 3 | 50 | — | 10 | 1.43 | 5500 |
| Ex. 21 | 3 | 50 | — | 35 | 3 | 50 | — | 30 | 1.47 | 5200 |
| Ex. 22 | 3 | 50 | — | 30 | 3 | 50 | — | 40 | 1.47 | 5000 |
| Ex. 23 | 3 | 50 | — | 45 | 3 | 50 | — | 40 | 1.48 | 4600 |
| Ex. 24 | 3 | 50 | — | 35 | 3 | 50 | — | 50 | 1.46 | 4600 |
| Ex. 25 | 3 | 50 | — | 60 | 3 | 50 | — | 70 | 1.41 | 4500 |
| Ex. 26 | 2 | 70 | — | 35 | 2 | 70 | — | 40 | 1.47 | 4500 |
| Ex. 27 | 1.5 | 50 | — | 20 | 1.5 | 50 | — | 10 | 1.4 | 5800 |
| Ex. 28 | 2 | 30 | — | 35 | 2 | 30 | — | 40 | 1.43 | 5000 |
| Ref. 6 | 1 | 20 | — | 10 | 1 | 20 | — | 40 | 1.38 | 5000 |
| Ref. 7 | 1 | 20 | — | 70 | 1 | 20 | — | 80 | 1.42 | 4000 |
| Ref. 8 | 1 | 20 | — | 35 | 1 | 20 | — | 5 | 1.39 | 5500 |

As a result of the tests, it was confirmed that the head of the embodiment had the remarkably improved resilience performance, while preventing degradation of durability, compared with the heads of the comparative examples.

The invention claimed is:

1. A hollow golf club head comprising:

a face for hitting a ball having a periphery and a face centroid, and a face peripheral portion extending rearward of the head from the periphery of the face and provided with only two reduced-rigidity portions, said each of the reduced-rigidity portions provided on the side of the hollow of the club head and consisting of a concave portion extending along the periphery of the face, said each of the reduced-rigidity portions having a depth in a range of from 0.2 to 1.0 mm and a width in a range of from 0.2 to 3.0 mm in a cross section perpendicular to a longitudinal direction of the concave portion, wherein in a standard state in which the head is placed on a horizontal plane so that a centerline of a shaft axis of the head is inclined at its lie angle within a vertical plane and the face is held at its loft angle, the reduced-rigidity portions consist of one toe-side reduced-rigidity portion provided on the toe side of the face centroid and one heel-side reduced-rigidity portion provided on the heel side of the face centroid, and when the head in the standard state is viewed from a direction of a normal of the face centroid, said toe-side reduced-rigidity portion has a center point P1 of its length located higher at the toe side of the face centroid, wherein an angle θt of a first straight line connecting the face centroid with the center point P1 of the toe-side reduced-rigidity portion with respect to the horizontal plane is in a range of from 30 to 45 degrees, and the heel-side reduced-rigidity portion has a center point P2 of its length located lower and the heel side of the face centroid, wherein an angle θh of a second straight line connecting the face centroid with the center point P2 of the heel-side reduced-rigidity portion with respect to the horizontal plane is in a range of from 30 to 50 degree.

2. The golf club head according to claim 1, wherein the head comprises:

a cup-shaped face member having the face and a flange portion which extends rearward of the head from the periphery of the face to constitute the face peripheral portion, and a head main body fixed to a rear side of the face member.

3. The golf club head according to claim 1, wherein said each reduced-rigidity portion has a longitudinal length in a range of from 5 to 60 mm.

4. The golf club head according to claim 1, wherein said reduced-rigidity portions has a smooth curved shape in a cross section perpendicular to the longitudinal of the concave portion.

5. The golf club head according to claim 1, wherein said reduced-rigidity portions are arranged on a corner formed between the face peripheral portion and the face, in a cross section perpendicular to the longitudinal direction of the concave portion.

6. The golf club head according to claim 1, wherein the face peripheral portion is an area within 10 mm from the periphery of the face to the rearward of the head.

7. The golf club head according to claim 1, wherein the angle θt is smaller than the angle θh.

8. The golf club head according to claim 1, wherein said toe-side reduced-rigidity portion and said heel-side reduced-rigidity portion have the same longitudinal length.

9. The golf club head according to claim 1, wherein the face peripheral portion has a flat exterior surface so that each of said toe-side reduced-rigidity portion and said heel-side reduced-rigidity portion has a small thickness.

* * * * *